US009232838B2

(12) United States Patent
Haight

(10) Patent No.: US 9,232,838 B2
(45) Date of Patent: Jan. 12, 2016

(54) RING COVER

(76) Inventor: Virginia Haight, Chicago, IL (US)

( * ) Notice: Subject to any disclaimer, the term of this patent is extended or adjusted under 35 U.S.C. 154(b) by 457 days.

(21) Appl. No.: 13/415,511

(22) Filed: Mar. 8, 2012

(65) Prior Publication Data

US 2013/0105336 A1 May 2, 2013

Related U.S. Application Data

(60) Provisional application No. 61/554,627, filed on Nov. 2, 2011.

(51) Int. Cl.
*A44C 9/00* (2006.01)
*A45C 13/00* (2006.01)

(52) U.S. Cl.
CPC ..... *A45C 13/002* (2013.01); *A44C 9/0092* (2013.01); *Y10T 29/49826* (2015.01)

(58) Field of Classification Search
CPC ..... A44C 9/0092; A45C 13/002
USPC ..... 63/15, 15.2–15.4, 15.8; 2/21; 29/896.412; D11/26
See application file for complete search history.

(56) References Cited

U.S. PATENT DOCUMENTS

| | | | | |
|---|---|---|---|---|
| 1,533,441 | A * | 4/1925 | Melling | 63/15.8 |
| 1,885,930 | A * | 11/1932 | Lowy | 63/15.8 |
| 2,048,317 | A * | 7/1936 | Berman | 63/15.8 |
| 4,245,485 | A | 1/1981 | Bushong | |
| 4,307,502 | A | 12/1981 | Scola | |
| 4,377,079 | A * | 3/1983 | Krueger | 63/15.8 |
| 4,845,777 | A | 7/1989 | Mersinas | |
| D377,769 | S | 2/1997 | Roemer | |
| 6,094,747 | A | 8/2000 | Malick | |
| 6,481,244 | B1 * | 11/2002 | Wright | 63/15.8 |
| 7,398,657 | B2 * | 7/2008 | Cleofas | 63/15 |
| 7,654,111 | B2 | 2/2010 | Alley et al. | |
| 2006/0218969 | A1 * | 10/2006 | Cleofas | 63/15.4 |
| 2008/0148776 | A1 * | 6/2008 | Alley et al. | 63/15.8 |
| 2012/0118016 | A1 * | 5/2012 | Maloney et al. | 63/15.8 |

* cited by examiner

*Primary Examiner* — Luan K Bui
(74) *Attorney, Agent, or Firm* — Sutherland Asbill & Brennan LLP

(57) ABSTRACT

A ring cover for accessorizing and/or protecting a ring worn on an individual's finger includes a protective band configured to encircle a ring. The protective band may have an aperture. The aperture may be configured to allow a user to display and/or pass a protruding center stone or other ornamentation of a ring therethrough.

15 Claims, 4 Drawing Sheets

RING COVER

This nonprovisional application claims the benefit of U.S. Provisional Application No. 61/554,627, filed Nov. 2, 2011.

BACKGROUND

An individual's most valuable or sentimental piece of jewelry is often a ring, such as a wedding band, engagement ring, athletic achievement ring, college ring, or a fashion ring. Such engagement or fashion rings typically include a center stone or other ornamentation, which protrudes away from the finger. In most rings, the center stone makes up a valuable and aesthetic portion of the ring.

However, engaging in activity, such as exercising, lifting weights, playing sports, swimming, household chores, or industrial occupations, may result in the ring becoming scratched or damaged. That is, the circular band portion of the ring facing the inside of the wearer's hand can become dented, leading to deterioration over time. Further, if the ring is poorly fitted to the wearer's finger, for example, due to swelling or shrinking of fingers with varying temperature conditions, activity may cause the ring to rotate or move around on the wearer's finger, potentially risking damage to the center stone or injury to the wearer. Jewelers often advise new ring owners to remove the ring prior to participating in certain activities, especially exercise or lifting weights. However, removing valuable rings prior to such activities increases the risk of loss or theft, and leaves the owner unable to display his or her ring during such activities.

SUMMARY

In view of the above, there exists a need for a ring cover that may be worn by an individual to protect the individual's ring, and/or as an accessory to the individual's ring. The ring cover may also reduce movement of the ring on the individual's finger during activity. The ring cover may further allow the individual to proudly display the center stone or other ornamentation of the ring.

In embodiments, a ring cover for accessorizing and/or protecting a ring includes a protective band formed at least in part from an elastic material and configured to encircle a ring. The protective band may have an aperture. The aperture may be configured to allow a user to display or pass a protruding center portion or other ornamentation of a ring therethrough.

DETAILED DESCRIPTION OF EMBODIMENTS

Figure 1:
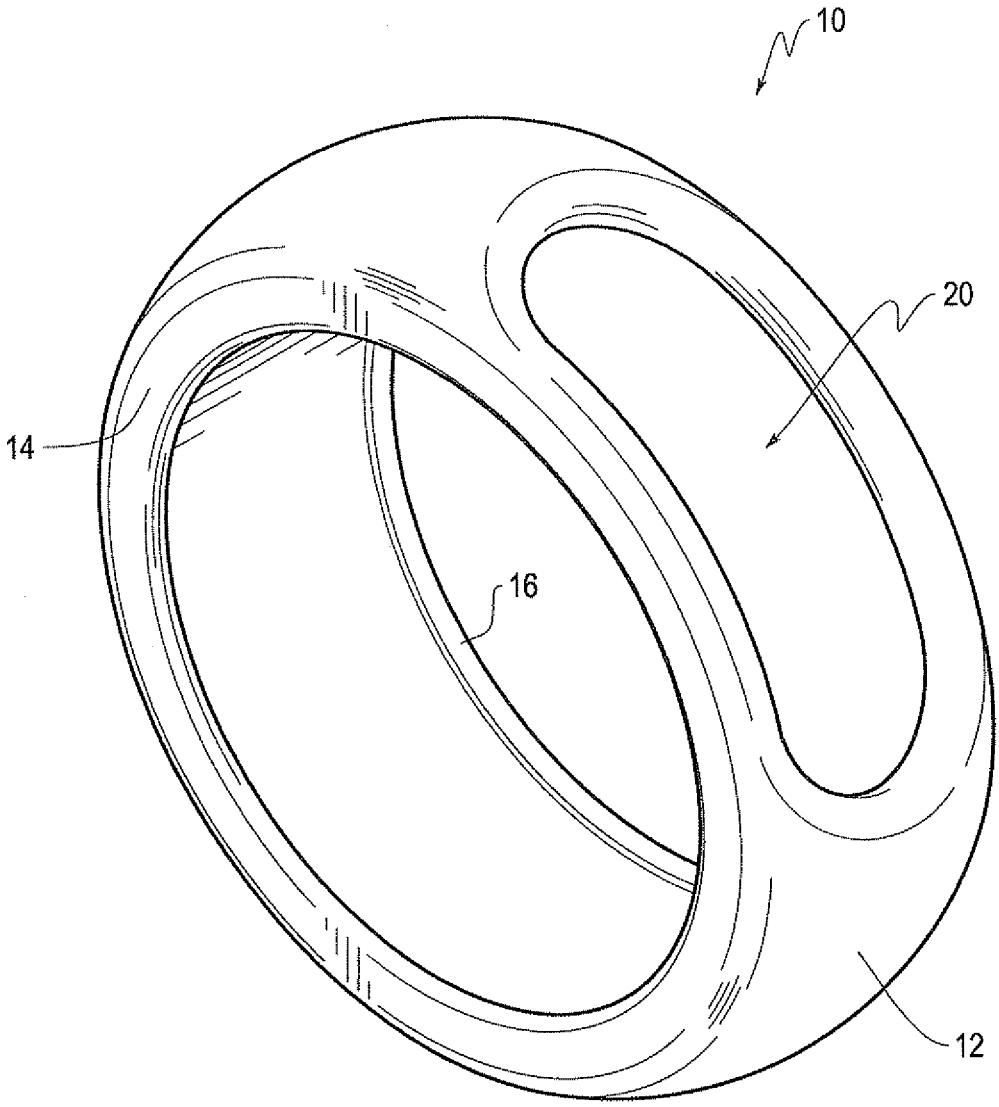
FIG. 1 is a perspective view of an embodiment of a ring cover.

FIGS. 1-6 show embodiments of a ring cover (10) that comprises a protective band (12) that is configured to encircle a ring. The protective band (12) may have a first circumferential edge (14) and a second circumferential edge (16). The first (14) and second (16) circumferential edges may curve inwards towards an inside portion of the protective band (12). The first (14) and second (16) circumferential edges may curve around a ring so that the protective band (12) may nestably receive the ring, and to allow for secure coupling of the ring cover (10) to the ring.

In embodiments, the ring cover (10) may be made at least in part of a flexible or elastic material adapted to stretch to an expanded configuration to more easily permit a user to couple the ring cover (10) to a ring, such that the protective band (12) encircles the ring. In embodiments, the ring cover (10) may be made in whole or in part of water-resistant or water-proof materials.

Figure 3:
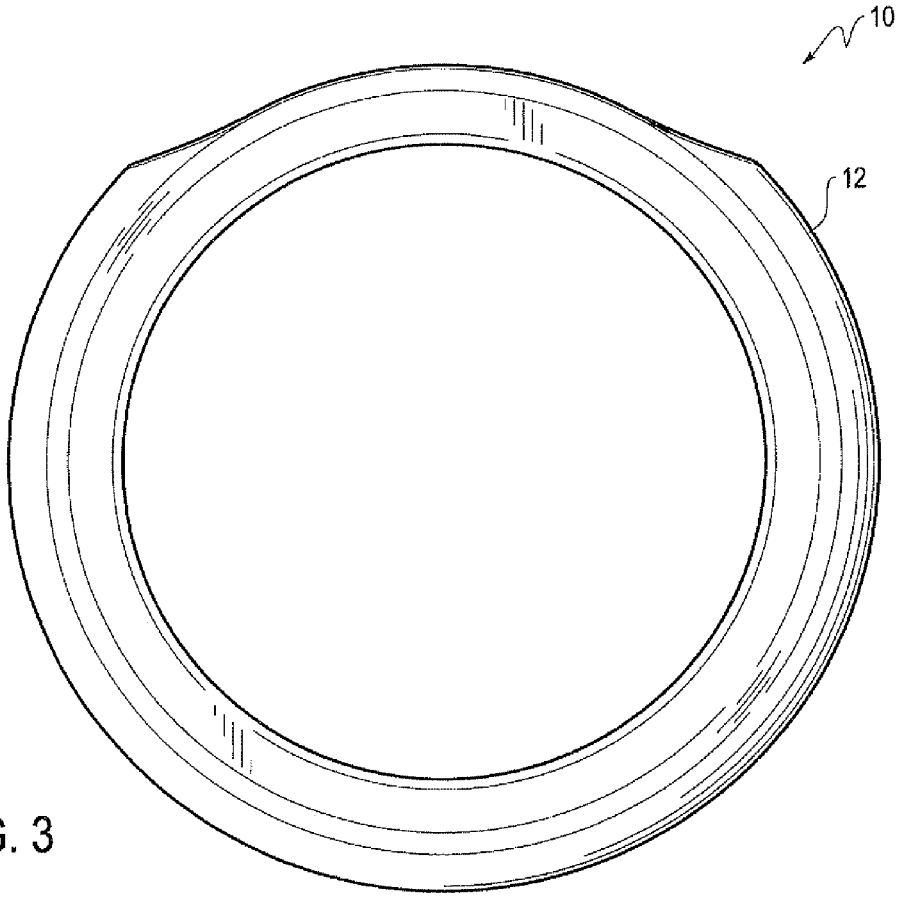
FIG. 3 is a side view of the ring cover of FIG. 1.

As best shown by FIG. 3, the protective band (12) may preferably, but not necessarily, be a continuous and non-separable band. In embodiments, the protective band (12) may be opaque, or it may be translucent or transparent, permitting at least partial view of the band of a ring that is coupled with the ring cover (10) through the translucent or transparent protective band (12). In embodiments, the opaque or translucent protective band (12) may be colored to further accessorize the user's ring, as desired by the wearer.

The protective band (12) may have dimensions such that in an expanded state, the inner circumference of the protective band (12) is greater than the outer circumference of a user's ring. For example, the protective band (12) may be adapted to one or more standard ring sizes. Moreover, the protective band (12) may have dimensions adapted to account for various ring widths and ring sizes. In embodiments, the protective band (12) may have dimensions suitable for use with standard ring sizes, exemplary dimensions of which are described in Table 1 below.

TABLE 1

| Inside Diameter (mm) | Inside Circumference (mm) | Number Sizes US/Canada Standard | Japanese Equivalent | Swiss Equivalent |
|---|---|---|---|---|
| 14.9 | 46.7 | 4 | 7 | |
| 15.3 | 48.0 | 4½ | 8 | |
| 15.7 | 49.3 | 5 | 9 | |
| 16.1 | 50.6 | 5½ | 10 | |
| 16.5 | 51.8 | 6 | 11 | 12.75 |
| 16.9 | 53.1 | 6½ | 13 | 14.00 |
| 17.3 | 54.4 | 7 | 14 | 15.25 |
| 17.7 | 55.7 | 7½ | 15 | 16.50 |
| 18.1 | 56.9 | 8 | 16 | 17.75 |
| 18.5 | 58.2 | 8½ | 17 | |
| 18.9 | 59.5 | 9 | 18 | |
| 19.4 | 60.8 | 9½ | 19 | |
| 19.8 | 62.1 | 10 | 20 | |
| 20.2 | 63.3 | 10½ | 22 | 22.75 |
| 20.6 | 64.6 | 11 | 23 | |
| 21.0 | 65.9 | 11½ | 24 | |
| 21.4 | 67.2 | 12 | 25 | 27.50 |
| 21.8 | 68.4 | 12½ | 26 | 28.75 |
| 22.2 | 69.7 | 13 | 27 | |
| 22.6 | 71.0 | 13½ | | |
| 23.0 | 72.3 | 14 | | |
| 23.4 | 73.5 | 14½ | | |
| 23.8 | 74.8 | 15 | | |
| 24.2 | 76.1 | 15½ | | |
| 24.6 | 77.4 | 16 | | |

Figure 2:
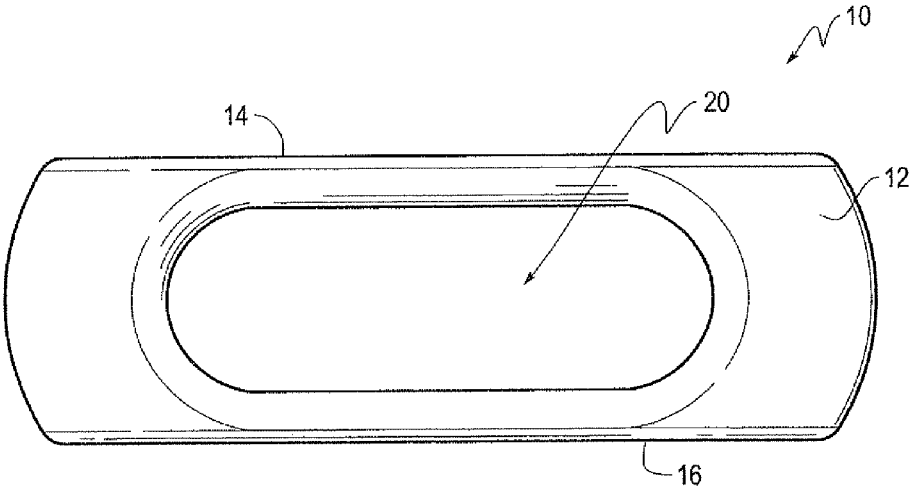
FIG. 2 is a top view of the ring cover of FIG. 1.

As shown by FIGS. 1-3, the protective band (12) may have an aperture (20) at a portion of the protective band (12) through which a user may display or pass a center portion such as a stone or other ornamentation of a ring.

As shown in FIG. 2, the aperture (20) of the protective band (12) may be oblong-shaped. The aperture (20) of the protective band (12) may be sized larger than a center stone or other ornamentation of a ring. In alternate embodiments, the aperture (20) may take on other shapes or sizes to suitably receive a smaller, larger, or non-conventionally-shaped center stone(s) or other ornamentation of a ring. For example, the aperture (20) may be circular, oval, or polygonal (e.g., square or rectangular), In embodiments, the aperture (20) may also be sized to account for various ring widths and sizes, and/or a plurality of apertures may be included, for example, for some custom rings with multiple protrusions (e.g., stones) or other ornamentation.

Figure 4:
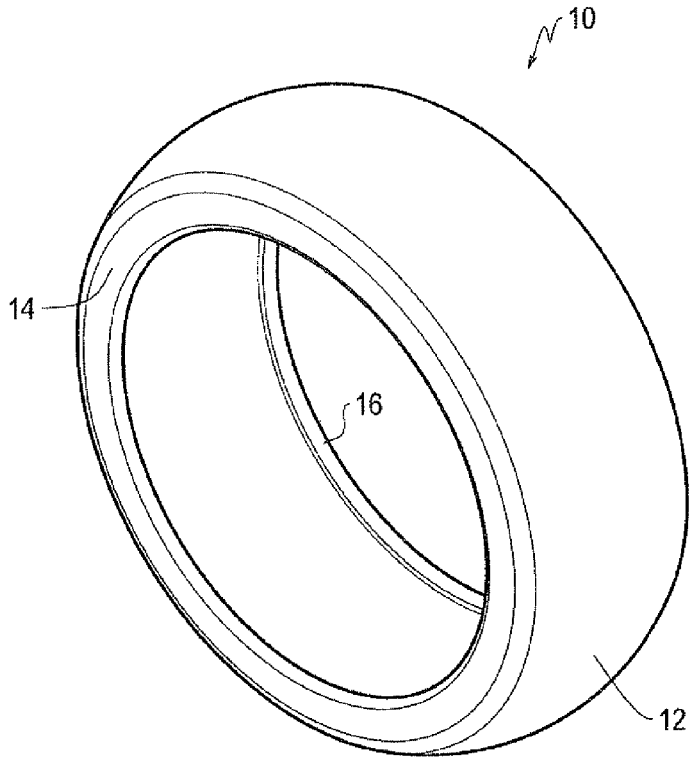
FIG. 4 is a perspective view of an embodiment of a ring cover.

As shown in FIG. 4, the ring cover (10) may not have an aperture in the protective band (12). Such embodiments may be suitable, for example, for protecting a ring such as a wedding band not having a center stone or other ornamentation, or may cover and protect a center stone or other ornamentation.

Figure 5:
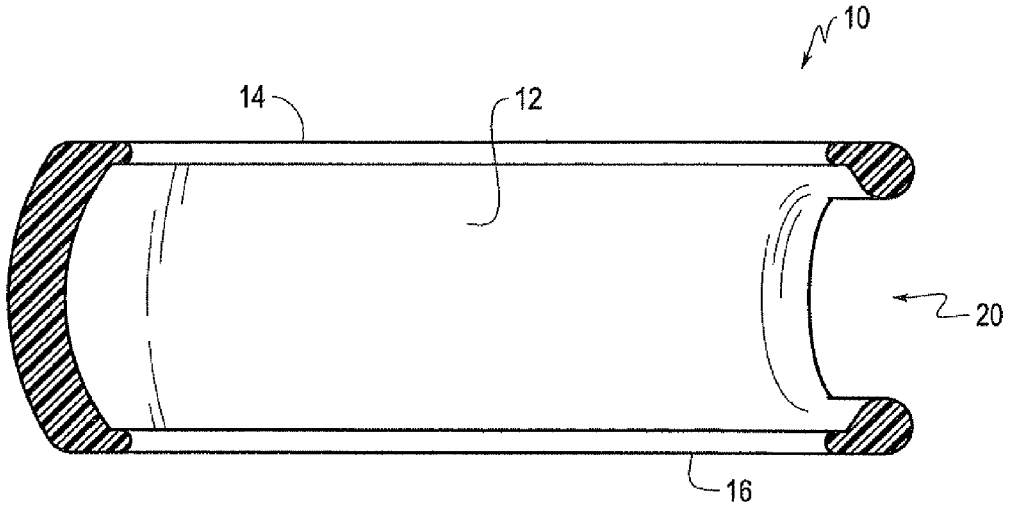
FIG. 5 is a cut-away view of a section of the interior of the ring cover of FIG. 1.

FIG. 5 shows a section of an interior portion of the ring cover (10). In embodiments, the width of the protective band (12) may be greater than the width of a user's ring. For example, the width may be in the range of 0.4 cm-1.8 cm, depending on the width of the ring. The thickness of the protective band (12) may vary to provide for sufficient expansion and protection characteristics and to account for shrinkage or expansion of a user's finger. For example, the protective band may have a thickness of 0.1 cm-0.3 cm.

Figure 6:
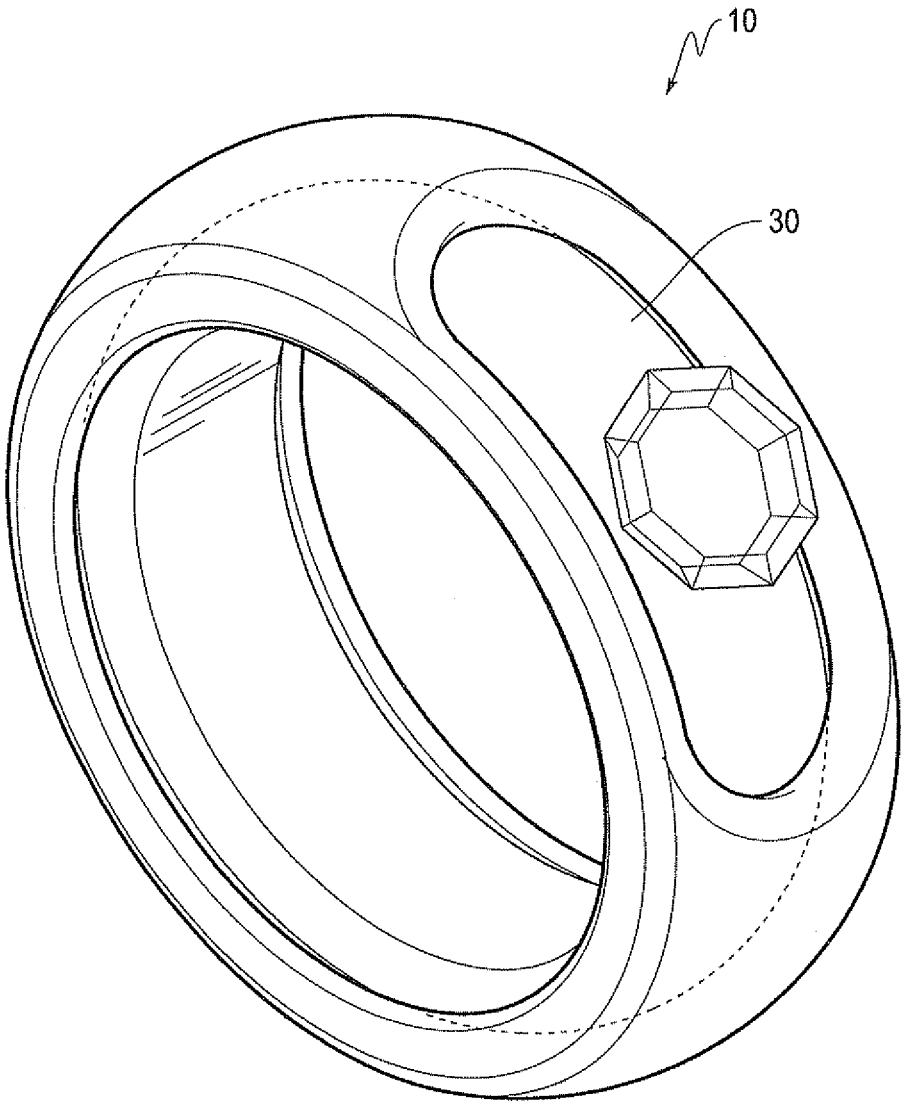
FIG. 6 is a perspective view of the ring cover of FIG. 1 when coupled to a ring.

FIG. 6 shows the ring cover (10) coupled with a ring (30). The ring cover (10) coupled with a ring (30) may be worn on an individual's finger as an accessory, and/or as a ring protector to protect the individual's ring. Coupling an individual's ring (30) with a ring cover (10) according to various embodiments discussed herein protects the individual's ring (30), especially during activity, while allowing a center stone or other ornamentation of the ring (30) to remain visible.

In embodiments, when the ring cover (10) is coupled to a ring (30), as shown in FIG. 6, the ring cover (10) may also prevent or inhibit movement of the ring (30) on the individual's finger during activity. For example, the ring cover (10) may frictionally engage human skin and prevent sliding of the ring (30) on a person's finger, often caused by liquid, such as water or perspiration. Additionally, the ring cover (10) may be adapted to account for expansion and contraction of a user's finger due to temperature changes, changes of the wearer's physical condition over the course of a day or longer time periods, or other conditions. For example, a user's finger may get slightly smaller, allowing movement or rotation of the ring (30) around a user's finger. To prevent slippage and/or to provide desired elastomeric properties, the protective band (12) may be made, for example, of silicone, silicone rubber, neoprene, or any other conventional material having a desired coefficient of friction with respect to human skin and/or having desired elastomeric properties.

Embodiments include methods for accessorizing and/or protecting a ring by coupling a ring (30) with the protective band (12) of the ring cover (10). Such methods may further include receiving a center stone or other ornamentation of a ring (30) through an aperture (20) in the protective band (12).

In embodiments, the coupling of the ring (30) with the protective band (12) includes expanding the protective band (12) of the ring cover (10) to an expanded configuration, inserting the ring (30) into the expanded configuration of the protective band (12), optionally such that a center stone or other ornamentation of the ring (30) is displayed or received by an aperture (20) in the protective band (12), and positioning the first (14) and second (16) circumferential edges of the protective band (12) around the ring (30) so that the ring (30) is nestably received by the protective band (12).

In embodiments, expanding the protective band (12) of the ring cover (10) to an expanded configuration may include gripping a portion of the protective band (12) and applying an outwardly force to expand the protective band (12) to an expanded configuration, so that the protective band (12) may be stretched over a ring (30) having an outer diameter greater than the inner diameter of the protective band (12) in a natural state. In embodiments, the ring (30) may be inserted into a portion of the protective band (12) and thereafter used to expand the protective band (12) to an expanded configuration by applying a radially outward force to the ring (30), which pushes on the protective band (12). Upon release of external forces, the protective band (12) may contract into its natural state. The ring (30) inserted into the protective band (12) may be inserted so that a center stone or other ornamentation of the ring (30) is received by an aperture (20) of the protective band (12).

In embodiments, positioning the first (14) and second (16) circumferential edges of the protective band (12) around the ring (30) may include gripping portions of the protective band (12) and adjusting the first (14) and second (16) circumferential edges to curve around the ring (30) so that the protective band (12) may nestably receive the ring (30).

The ring cover may be made by conventionally known methods, including but not limited to injection molding or the like.

It should be understood that the foregoing disclosure emphasizes certain specific embodiments of the invention and that modifications or alternatives equivalent thereto are within the spirit and scope of the invention.

What is claimed is:

1. A ring cover for a ring to be worn by an individual, comprising:

a protective band formed from flexible or elastic material and configured to encircle a ring, the protective band having a first edge, a second edge, an outer surface, an inner surface, and an aperture configured to allow the individual to pass a protruding center stone or other ornamentation of the ring therethrough, wherein:

the inner surface of the protective band faces the ring worn by the individual;

the first and second edges have a width that spans in an inwardly direction across the ring from the outer surface of the protective band towards a finger of the individual wearing the ring, the first and second edges each form a first circumference in a position nearest the outer surface of the protective band and a second circumference in a position of contact with the finger of the individual wearing the ring, wherein the first circumference is greater than the second circumference, and the first and second edges are curved towards the inside surface of the protective band so as to nestably receive the ring; and the aperture has an oblong configuration and is substantially rectangular in shape along a circumferential direction of the protective band.

2. The ring cover according to claim 1, wherein the protective band is a continuous band.

3. The ring cover according to claim 2, wherein the protective band is elastic.

4. The ring cover according to claim 1, wherein the protective band is translucent or transparent.

5. The ring cover according to claim 1, wherein the flexible or elastic material is waterproof or water-resistant.

6. The ring cover according to claim 1, wherein the flexible or elastic material is selected from the group consisting of silicone, silicone rubber, and neoprene.

7. The ring cover according to claim 1, wherein the protective band is configured to expand so that an inner circumference of the protective band is greater than an outer circumference of a user's ring.

8. The ring cover according to claim 1, wherein the protective band has a thickness of 0.1 cm-0.3 cm.

9. The ring cover according to claim 1, wherein the protective band is configured to expand at least one standard ring size.

10. A method of accessorizing or protecting a ring to be worn by an individual, comprising:

coupling a ring with the ring protector according to claim 1 such that the ring is nestably received by the protective band with the protective band covering a majority of an outer surface of the ring.

11. The method of accessorizing or protecting a ring according to claim 10, further comprising inserting a center stone or other ornamentation of the ring through the aperture in the protective band.

12. The method of accessorizing or protecting a ring according to claim 10, wherein coupling of the ring with the protective band comprises:

expanding the protective band of the ring cover to an expanded configuration; and positioning the curved edges of the protective band around the ring so that the ring is nestably received and substantially covered by the protective band of the ring cover.

13. The method of accessorizing or protecting a ring according to claim 12, further comprising inserting the ring into the expanded configuration of the protective band, such that a center stone or other ornamentation is displayed or received by an aperture in the protective band.

14. The method of accessorizing or protecting a ring according to claim 11, wherein the aperture is larger than the protruding center stone or other ornamentation of the ring.

15. The method of accessorizing or protecting a ring according to claim 10, wherein the protective band inhibits movement of the ring on or around an individual's finger.

* * * * *